US009540838B2

(12) United States Patent
Black et al.

(10) Patent No.: US 9,540,838 B2
(45) Date of Patent: Jan. 10, 2017

(54) ACCESS PANEL

(76) Inventors: Robert David Black, Bicester (GB); John Alexander Black, Bicester (GB)

( * ) Notice: Subject to any disclaimer, the term of this patent is extended or adjusted under 35 U.S.C. 154(b) by 0 days.

(21) Appl. No.: 13/390,811

(22) PCT Filed: Aug. 18, 2010

(86) PCT No.: PCT/GB2010/051363

§ 371 (c)(1),
(2), (4) Date: Feb. 16, 2012

(87) PCT Pub. No.: WO2011/021035

PCT Pub. Date: Feb. 24, 2011

(65) Prior Publication Data

US 2012/0144746 A1 Jun. 14, 2012

(30) Foreign Application Priority Data

Aug. 18, 2009 (GB) ..... 0914424.7

(51) Int. Cl.
*E06B 3/92* (2006.01)
*E04H 5/06* (2006.01)
*E06B 9/06* (2006.01)

(52) U.S. Cl.
CPC ..... *E04H 5/06* (2013.01); *E06B 9/063* (2013.01); *E06B 9/0661* (2013.01)

(58) Field of Classification Search
CPC ..... E06B 9/0661; E06B 9/063; E04H 5/06; B60S 3/04; B65D 43/20
USPC ..... 160/136–165; 52/169.6, 169.7, 19
See application file for complete search history.

(56) References Cited

U.S. PATENT DOCUMENTS

| | | | | | |
|---|---|---|---|---|---|
| 807,276 | A | * | 12/1905 | Johnston | 160/102 |
| 2,001,181 | A | * | 5/1935 | Burcham | 160/159 |
| 2,779,990 | A | * | 2/1957 | Van Den Bos | 249/189 |
| 3,074,079 | A | | 1/1963 | Isaacson | |
| 3,506,056 | A | * | 4/1970 | Quinones et al. | 160/160 |
| 3,674,081 | A | * | 7/1972 | List | 160/161 |
| 4,628,646 | A | * | 12/1986 | Eyerle | 52/71 |
| 4,762,242 | A | * | 8/1988 | Harris et al. | 220/484 |

(Continued)

FOREIGN PATENT DOCUMENTS

| | | |
|---|---|---|
| DE | 34 06 204 A1 | 8/1985 |
| DE | 34 15 516 A1 | 10/1985 |

(Continued)

*Primary Examiner* — Katherine Mitchell
*Assistant Examiner* — Jeremy Ramsey
(74) *Attorney, Agent, or Firm* — Davis & Bujold PLLC; Michael J. Bujold

(57) ABSTRACT

An access panel for a horizontal opening, the access panel (11) comprises a parallel array (12) of members (14, 15, 16) and a lateral extent (W) of the array (12) corresponding to a lateral extend (D) of the opening between first (17) and second (18) end members of the array (12) defining a length (L) of the panel (12). At least two pantograph units (20, 21) extend between the first (17) and second (18) end members and each member (14-16, etc.) in the parallel array (12) is pivotably linked to each pantograph unit. The members (14, 15, 16 etc) and units (20, 21) permit the panel (11) to function as a planar structure and enable the length (L) of the panel (11) to be varied between a minimum length (L1) and a maximum length (L2) and an intermediate configuration having a length between the minimum and maximum lengths (L1, L2).

6 Claims, 3 Drawing Sheets

(56) References Cited

U.S. PATENT DOCUMENTS

| | | | | | |
|---|---|---|---|---|---|
| 4,966,217 | A | * | 10/1990 | Dechambeau et al. | 160/35 |
| 5,189,836 | A | | 3/1993 | Alder et al. | |
| 5,379,823 | A | * | 1/1995 | Kraeutler | 160/271 |
| 5,535,803 | A | * | 7/1996 | Pretorius | 160/136 |
| 5,738,160 | A | * | 4/1998 | Rice | E04H 5/06 160/201 |

FOREIGN PATENT DOCUMENTS

| | | | | |
|---|---|---|---|---|
| JP | 2007016539 | A | * | 1/2007 |
| WO | 2009/138772 | A2 | | 11/2009 |

* cited by examiner

ACCESS PANEL

TECHNICAL FIELD

This invention relates to an access panel. It is particularly, but not exclusively, concerned with a safety device for use in connection with a horizontal floor opening through which an individual could inadvertently fall.

BACKGROUND ART

A number of industries make use of a work area in which wheeled units are worked on. Typically a garage or other workspace for car maintenance, repair or construction needs to be able to access a vehicle from any direction. In order to work on the underside of the vehicle there is a need for a pit over which the vehicle can be place to enable an operative to enter the pit to access the underside of the vehicle. With a vehicle in place over a pit opening so as to fully cover the opening then inadvertent falling is prevented. However, once the vehicle is removed from the pit opening, the pit opening becomes a hazard until some form of barrier is put in place.

Various methods have been used to prevent inadvertent entry into such a pit. These include a vertical barrier extending around the pit periphery or baulks of timber inserted to lie on a rim about the pit opening so as to be flush with surrounding floor area. However, these methods require action by somebody and take time to carry out. In addition, if the person working in the pit on a vehicle subsequently climbs out and the vehicle is moved away from the pit, the pit opening is left unguarded until a person arrives to rectify the situation. Whatever physical barrier is used can be supplemented by signs, lights or sounding means.

In our co-pending application PCT/GB2009/050460 there is described a retractable safety device for use in regulating entry to a hazard area from an access area comprising: a parallel array of members each member in the array having—a first end pivotally attached to a first side rail to which each member is pivotally attached by a first end of each array member; a second side member to which each member in the array is pivotally attached by a second end of each array member; the array and first and second side arrays being displaceable in a plane between a first, working, configuration in which the first and second side members are relatively wide apart; and a second, stowage, configuration where the first and second side members are relatively close; at least two slide arms, each slide arm being located on, and pivotally connected to, the second side member; the slide arms being spaced apart on the second side member; a slider mounted on each side arm adapted to slide along the slide arm on which it is mounted, each slider including means whereby the slider can be secured to a region in or near the hazard area so as to permit the slide arm to be displaceable relative to the slider; and stop means to limit the extent of travel of the slide arm relative to the slider so as to define the second, stowage, configuration; the device providing that with the array in the first, working, configuration the array serves to obstruct passage from the access area into the hazard area; and with the array in the second, storage, configuration the array is withdrawn from obstructing passage from the access area into the hazard area. Hereafter, a safety device of this type will be referred to a being 'of the type described'.

When a vehicle covers and entire pit opening, then it provides a complete barrier to inadvertent pit entry. However, access to the pit for work on the vehicle is also prevented. In the event a vehicle covers only a party of the pit opening, access to the pit to work on the vehicle is readily available but the exposed section of the opening remains a hazard.

DISCLOSURE OF INVENTION

An access panel for use in conjunction with a horizontal opening; recesses (41, 42) incorporated in the sides of longitudinal edges of the horizontal opening the access panel (11) comprising a parallel array (12) of members (14, 15, 16) with a longitudinal axis; the lateral extent (W) of the array (12) corresponding to a lateral extend (D) of the opening and first (17) and second (18) end members of the array (12) defining a length (L) of the panel (12) characterized by at least two pantograph units (20, 21) extending between the first (17) and second (18) end members; each member (14-16, etc.) in the parallel array (12) being pivotably linked to each pantograph unit; the combination of members (14, 15, 16 etc.) and units (20, 21) providing for the panel (11) to function as a planar structure and enabling the length (L) of the panel (11) to be varied between a first configuration wherein the panel has a minimum length (L1) measured between the first (17) and second (18) end members; a second configuration wherein the panel has a maximum length (L2) measured between the first (17) and second (18) end members or an intermediate configuration having a length intermediate the minimum length (L1) and the maximum length (L2).

According to a first preferred version of the present invention, lateral ends of at least some of the members (14-16, etc.) of the array (12) are adapted for sliding on a support means to provide for the panel to be readily varied in length by low frictional contact between the adapted ends and the support means.

DESCRIPTION OF DRAWINGS

An exemplary embodiment of the invention will now be described with reference to the accompanying drawings of an access panel of which.

MODE FOR CARRYING OUT THE INVENTION

Figure 1:
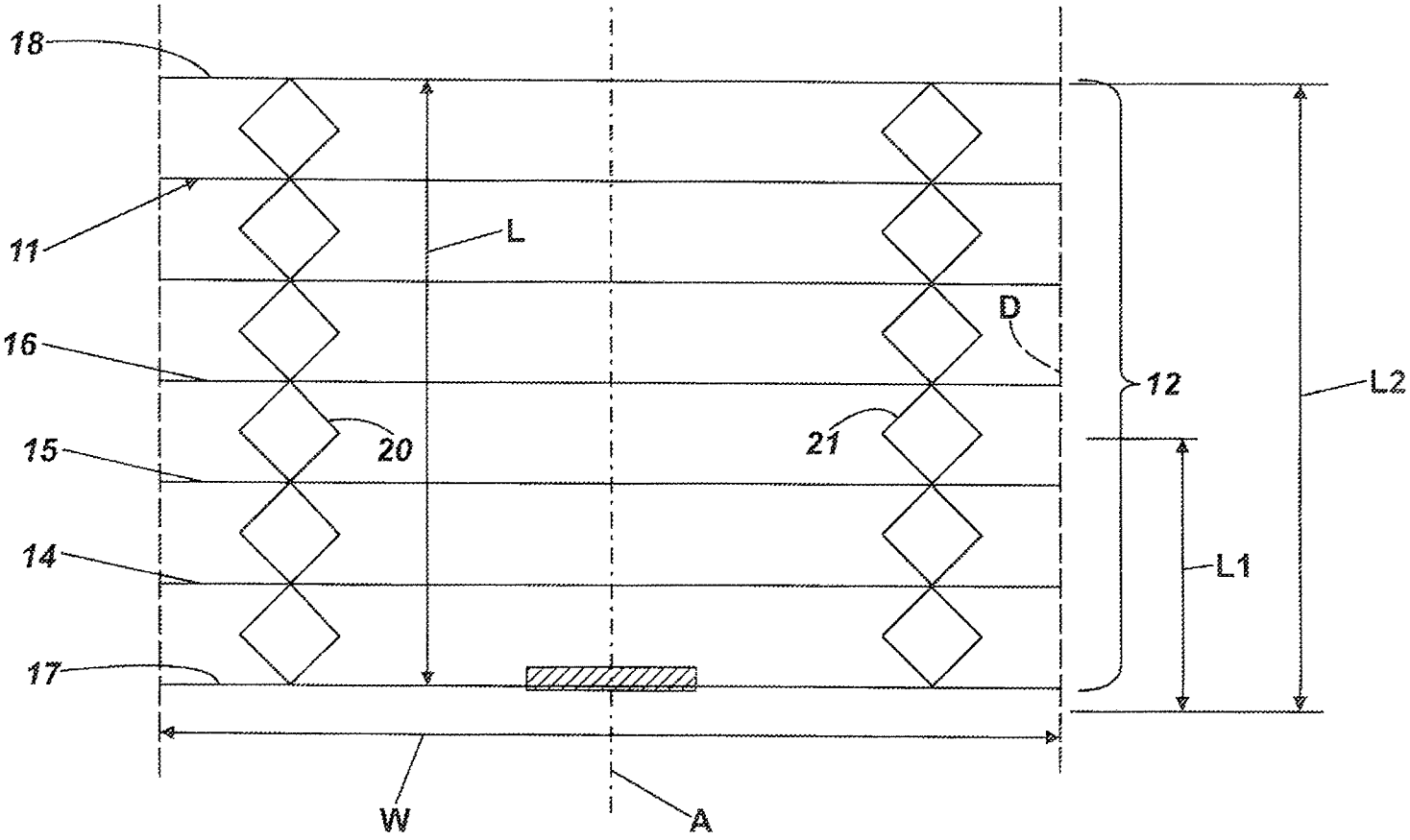
FIG. 1 is a diagrammatic plan view.

The figures variously show an access panel 11 madeup of a parallel array 12 of members (typically members 14, 15, 16) with a longitudinal axis A. The lateral extent W of the array 12 corresponds to lateral extent of opening D. First end member 17 of the array and second end member 18 between them defining the length L of the panel 11 which length can be varied as will be described hereafter.

Pantograph unit 20, 21 extends between the first and second end members 17, 18. The pantograph 20 (pantograph 21 being identical in form and function) comprises a sequence of strips pivotably attached at the centers to a member of the array 12 and at their end to the ends of adjacent strips so providing for the array to be altered in length while the members of the array are maintained parallel to and equidistant from one another. If necessary, a locking device can be used to that at a given length of the array the distance between the first and second end members cannot be changed inadvertently.

Each member 14, 15, 16, 17, 18 etc., in the parallel array 12 is pivotably linked to each pantograph unit 20, 21 to provide for a combination of pivotably linked members and units resulting in the panel 11 functioning as a planar structure and enabling the length of the panel 11 to be varied longitudinally between:

a first configuration wherein the panel 11 can be maintained at a minimum length L1 measured between the first and second end members 17, 18; or a second configuration wherein the panel can be maintained at a maximum length L2 measured between the first and second end members 17, 18; or any intermediate length intermediate of the minimum and maximum lengths.

The extremities of the members (14-18 etc.) are provided with a low friction coating to enable the extremities to slide readily in channels recesses (41, 42) incorporated in the sides of longitudinal edges of the pit 40.

Figure 2:
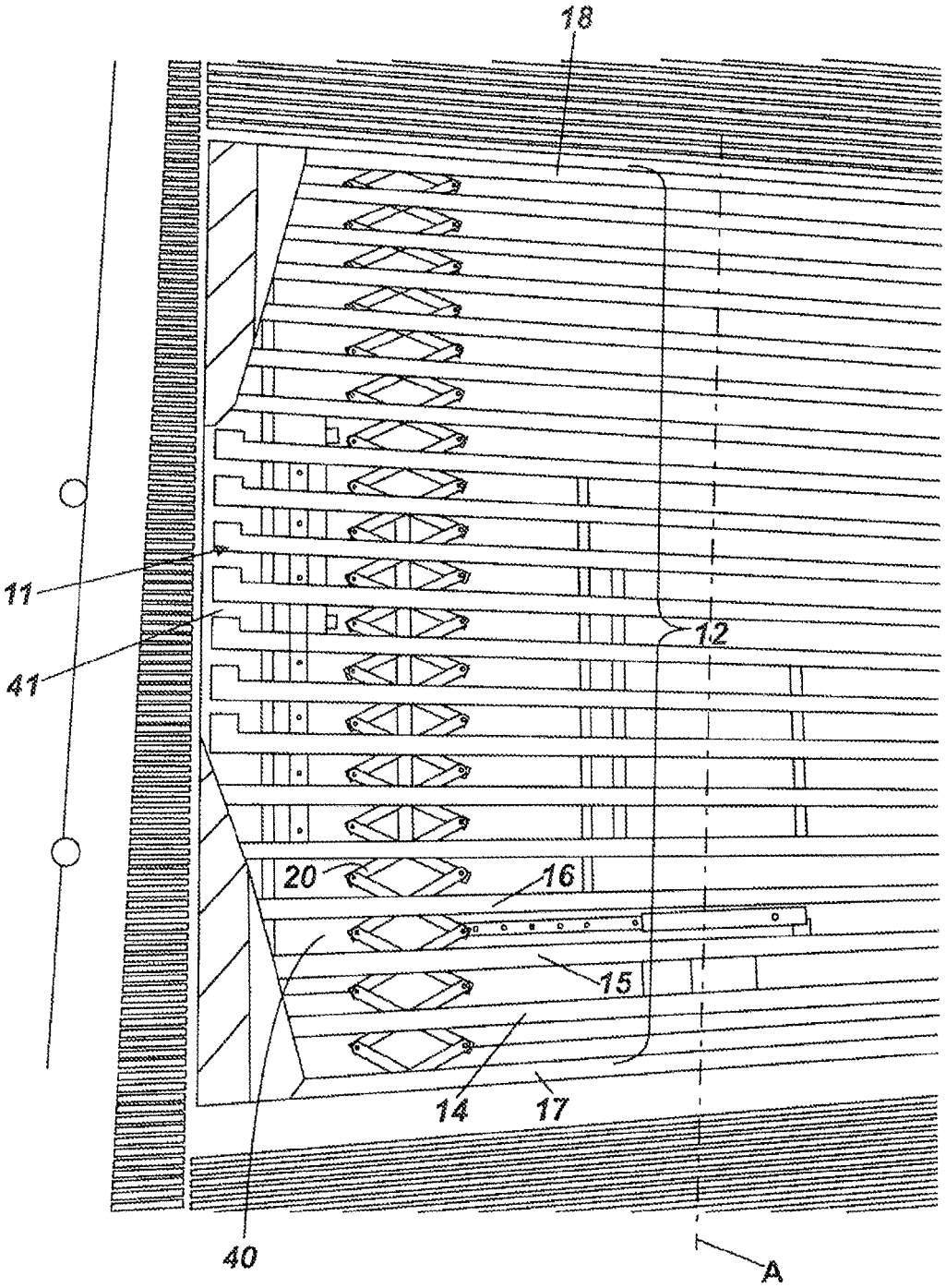
FIG. 2 is a view from above of an installed access panel.
Figure 3:
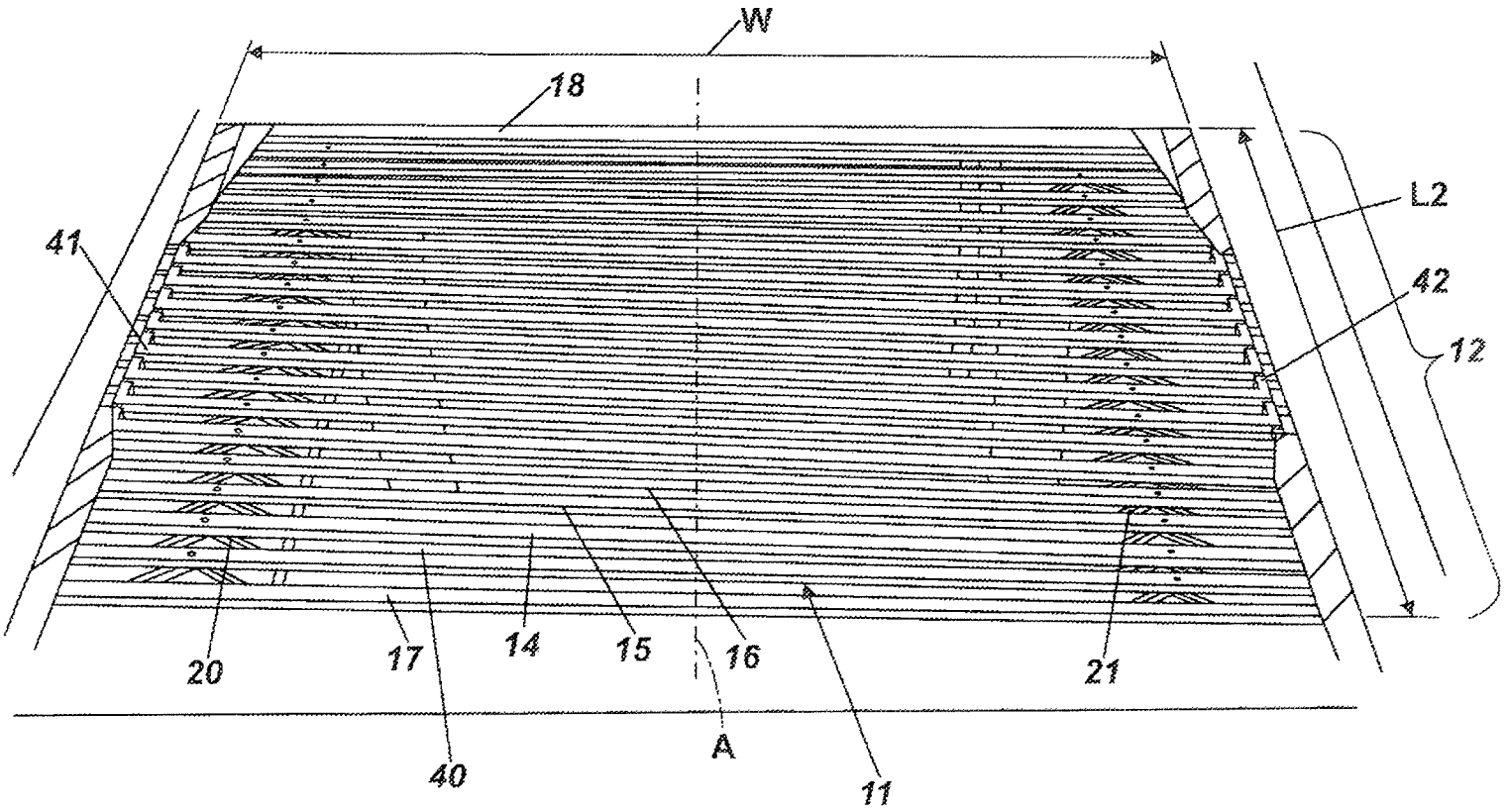
FIG. 3 is a perspective view of the panel of FIG. 2.

As shown in FIGS. 2 and 3, the panel 11 is located over a pit 40 by being mounted by means of the extremities of the members in the array 12 in recesses 41, 42 incorporated in the sides of longitudinal edges of the pit periphery 43. The extremities of the members (14-18, etc.) are provided with a low friction coating to enable the extremities to slide readily in channels 41, 41 when the length of the array 12 is varied, as outlined earlier.

The panel 11 provides for a number of uses. For example in the event the pit 40 is partially covered by a vehicle and co-extensively by a retractable safety device, the subject of our co-pending application PCT/GB2009/050460, then the uncovered section can be readily closed by means of the panel 11 with its length L set appropriately. The panel 11 is relatively light and easily handled and positioned so encouraging its use by an operative, in contrast to conventional safety means.

INDUSTRIAL APPLICABILITY

The invention provides a safety device which can be readily set up and readily removed particularly, but not exclusively, for a pit for vehicle servicing. The device is readily mounted whether in an existing pit installation or in a new one.

The invention claimed is:

1. A removable and positionable access panel for use with a horizontal opening in a floor, the horizontal opening having longitudinal edges, the longitudinal edges having sides and recesses incorporated in the sides of the longitudinal edges of the horizontal opening, the access panel comprising a parallel array of members arranged along a longitudinal axis, and the parallel array of members comprising a first end member and an opposed second end member, wherein a lateral extent (W) of the parallel array corresponds to a lateral extent (D) of the horizontal opening and a spacing between the first and the second end members of the parallel array defines a longitudinal length (L) of the panel, the parallel array of members, including the first end member, a plurality of intermediate members and the second end member, all lying in a single plane when the access panel is covering the horizontal opening in the floor, and the access panel comprises at least two pantograph units extending between the first and the second end members, each member in the parallel array being pivotally linked to each pantograph unit, a combination of the members in the parallel array and the pantograph units forming a rigid planar structure which prevents inadvertent entry into the horiztonal opening and enabling the longitudinal length (L) of the panel to be varied between a first configuration, in which the panel has a minimum length (L1) measured between the first and the second end members, and a second configuration, in which the panel has a maximum length (L2) measured between the first and the second end members and an intermediate configuration having a length intermediate the minimum length (L1) and the maximum length (L2), a spacing between each member of the parallel array of members varies as the panel moves from the minimum length (L1) to the maximum length (L2), and vice versa, the first end member is movable toward the second end member and into the first configuration in order to provide access to the horizontal opening in the floor, and the second end member is movable toward the first end member and into the first configuration in order to provide access to the horizontal opening in the floor.

2. The removable and positionable access panel of claim 1, wherein the members of the parallel array have lateral ends and the lateral ends of at least some of the members of the parallel array are received within the recesses and comprise a low friction coating to facilitate sliding of the members of the parallel array in the recesses and varying the longitudinal length of the panel by sliding at least one of the first and the second end members in relation to each other and with respect to the longitudinal edges of the horizontal opening.

3. The removable and positionable access panel of claim 1, wherein the first and the second end members are adjustable with respect to the longitudinal edges of the horizontal opening such that the longitudinal length of the panel is adaptable with respect to a distance between the longitudinal edges of the horizontal opening to at least partially cover the horizontal opening in each of the first configuration, the intermediate configuration and the second configuration.

4. The removable and positionable access panel of claim 1, wherein opposed lateral extremities of the members of the parallel array located between the first and the second end members are coated with a low friction coating to enable the lateral extremities to slide readily along a respective recess of the horizontal opening, the recesses in the sides of the longitudinal edges of the horizontal opening being channels.

5. A readily removable and positionable access panel access panel for covering a horizontal floor opening, the horizontal floor opening being defined by opposed longitudinally extending edges and opposed laterally extending edges, the longitudinally extending edges and laterally extending edges of the floor opening being fixed in relation to each other, the longitudinally extending edges having channels incorporated therein, wherein the access panel comprises:

a parallel array of elongate members, the elongate members extend from a first of the longitudinally extending edges to a second of the longitudinally extending edges, and are aligned at least substantially normal to the longitudinally extending edges, the parallel array of elongate members comprising a first end member, an opposed second end member and a plurality of intermediate members, and the parallel array of elongate members having opposite ends that are supported in a respective one of the channels incorporated in the longitudinally extending edges, at least two pantograph units extending between the first and the second end members of the array of elongate members, each of member the array of elongate members is pivotally linked to each of the at least two pantograph units such that the members of the array of elongate members are maintained parallel to each other and a spacing between adjacent members of the array of elongate members is variable as the panel expands and contracts between first and second configurations, and the first end member and the second end member of the panel are adjustable with respect to each other and with respect to the laterally extending edges of the floor opening, and a combination of the members in the array and the pantograph units forming a rigid planar structure which prevents inadvertent entry into the horizontal floor opening, the first end member, the plurality of intermediate members and the second end member of the panel being adjustable between the first configuration, in which the panel has a minimum distance and spacing between the first and the second end members, and the second configuration, in which the panel has a maximum distance spacing between the first and the second end members and an intermediate configuration having an intermediate distance that is between the minimum distance and the maximum distance, the array of elongate members, including the first end member, the plurality of intermediate members and the second end member, all lying in a single plane when the access panel is covering the horizontal opening in the floor and the access panel is in each of the first configuration, the second configuration and the intermediate configuration, and the first end member is movable toward the second end member and into the first configuration in order to provide access to the horizontal opening in the floor, and the second end member is movable toward the first end member and into the first configuration in order to provide access to the horizontal opening in the floor.

6. A readily removable and positionable access panel for use in covering a horizontal opening in a floor, the horizontal opening having opposed longitudinal edges and opposed laterally extending edges, the longitudinal edges having sides and recesses incorporated in the sides of the longitudinal edges of the horizontal opening, the access panel consisting of a parallel array of members arranged along a longitudinal axis, and the parallel array of members consisting of a first end member and an opposed second end member and a plurality of intermediate members located therebetween, and each of the first end member, the second end member and the plurality of intermediate members lying in a single plane when the access panel is covering the horizontal opening in the floor, wherein a lateral extent (W) of the parallel array corresponds to a lateral extent (D) of the horizontal opening and spacing between the first and the second end members of the parallel array define a longitudinal length (L) of the panel, and the access panel comprises at least two pantograph units extending between the first and the second end members, each of the first end member, the second end member and the plurality of intermediate members of the parallel array are pivotally linked to each pantograph unit, a combination of the first end member, the second end member and the plurality of intermediate members of the parallel array and the pantograph units forming a rigid planar structure which prevents inadvertent entry into the horizontal opening and enabling the longitudinal length (L) of the panel to be varied between a first configuration, in which the panel has a minimum length (L1) measured between the first and the second end members in which the first end member, the second end member and the plurality of intermediate members all lying in the single plane, and a second configuration, in which the panel has a maximum length (L2) measured between the first and the second end members in which the first end member, the second end member and the plurality of intermediate members all lying in the single plane, and an intermediate configuration having a length intermediate the minimum length (L1) and the maximum length (L2) in which the first end member, the second end member and the plurality of intermediate members all lying in the single plane, and a spacing between each of the first end member, the second end member and the plurality of intermediate members of the parallel array varies as the panel extends from the minimum length (L1) to the maximum length (L2), and vice versa, the first end member is movable toward the second end member and into the first configuration in order to provide access to the horizontal opening in the floor, and the second end member is movable toward the first end member and into the first configuration in order to provide access to the horizontal opening in the floor.

* * * * *